US006652298B2

(12) United States Patent
Ohnuki

(10) Patent No.: US 6,652,298 B2
(45) Date of Patent: Nov. 25, 2003

(54) CONNECTOR

(75) Inventor: Shigeru Ohnuki, Yokohama (JP)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 10/000,108

(22) Filed: Oct. 30, 2001

(65) Prior Publication Data

US 2002/0081877 A1 Jun. 27, 2002

(30) Foreign Application Priority Data

Nov. 2, 2000 (JP) ..... 2000-336675

(51) Int. Cl.[7] ..... H01R 13/62
(52) U.S. Cl. ..... 439/157; 439/372
(58) Field of Search ..... 439/157, 153, 439/152, 310, 372

(56) References Cited

U.S. PATENT DOCUMENTS 6,558,176 B1 * 5/2003 Martin et al. ..... 439/157

FOREIGN PATENT DOCUMENTS

EP 0940886 A1 9/1999
EP 099145 A2 4/2000
EP 1005112 A2 5/2000
EP 1024560 A2 8/2000

* cited by examiner

*Primary Examiner*—Khiem Nguyen
(74) *Attorney, Agent, or Firm*—Perman & Green, LLP

(57) ABSTRACT

The invention offers a connector which allows the stable insertion of a plurality of pairs of socket contacts and plug contacts that mutually fit together with the use of an operation lever. The invention provides at least two engaging protrusions which are spaced apart in the direction orthogonal to the engaging direction on the opposing pair of side surfaces of a first casing, provides on the opposing pair of sidewalls 14*a*, 14*b* of the other casing 6, a pair of engaging plates 9 which can move in the direction orthogonal to the engaging direction, an operation lever 10 which can swing in order to move said plates 9 in a straight line, and guiding grooves 28, 29 which allow the insertion of the engaging protrusions, provides on each of the engaging plates 9, at least two engaging grooves 33, 34 which are parallel to each other and where the engaging protrusions are inserted, having slanting portions 33*b*, 34*b* which are slanted with respect to the engaging direction, while providing on the sidewalls 14*a*, 14*b* of the casing 6, a pair of sliding grooves 27 which can store and allow the sliding of said engaging plates 9 in the direction orthogonal to the engaging direction.

6 Claims, 7 Drawing Sheets

CONNECTOR

BACKGROUND OF THE INVENTION

The present invention relates generally to connectors, more specifically to connectors which employs the method of swinging an operation lever in order to connect a multitude of plug contacts and socket contacts.

An example of this conventional type of connector is illustrated as the structure shown in FIG. 11. This connector 60, for example, provides a plug-side connector 62 which stores a plurality of plug contacts 61 (see FIG. 12) and a socket-side connector 64 which stores in an array formation a plurality of socket contacts 63 which connects to those plug contacts 61 respectively.

Since a large insertion force is necessary in order to simultaneously insert the plurality of plug contacts 61 into the plurality of socket contacts 63, generally, an operation lever 65 is provided on the connector 60 which can amplify the applied insertion force. This operation lever is attached so as to allow a swinging motion around the axis 66 displaced near the center of both of the side surfaces of said plug-side connector 62. The ends of the operation lever 65 are, at both sides of said plug-side connector 62, open on one end and forming engaging grooves 67 in an arc-shape which gradually gets closer to said axis 66 as they approach the other end.

Meanwhile, engaging protrusions 68 are provided near the center of both of the side surfaces of said socket-side connector 64 which are to be inserted into said engaging grooves 67, respectively.

When engaging these plug-side connector 62 and socket-side connector 64, the plug contacts 61 and the socket contacts 63 within the connectors 62, 64 are positioned to line up, said engaging protrusions 68 are engaged with the engaging grooves 67 of said operation lever 65, and said operation lever is swung. Accordingly, the engaging protrusions 68 are pulled towards the plug-side connector 62 along the engaging grooves 67, and both of the connectors 62, 64 can engage.

Additionally, the plug-side connector 62 provides a first casing portion and a second casing portion separated along the center line in the thickness direction (not shown). Both casing portions are assembled to sandwich a plug body which stores the plurality of wired plug contacts 61, and forms the plug-side casing which possess a box shape and which stores said plug body. And then, the square C-shaped operation lever 65 is attached to both side surfaces of the plug-side casing so as to straddle both of the casings.

As shown in FIG. 12, the socket contacts 63 which are stored in said socket-side connector 64 possess, on the outer surface, a brim portion 63*a* protruding in a radial direction and an elastic protrusion 63*b* which can protrude in a radial direction. Then, the socket contacts 63 are inserted from the back of the through hole 69 which possess a step formed on the socket-side connector, and by having said elastic protrusion 63*b* protrude in front of the step portion 69*a* of said through hole 69, said step portion 69*a* is sandwiched between the elastic protrusion 63*b* and the brim portion 63*a* and is held firmly by the socket-side connector 64.

On the other hand, in order to allow the disengagement of the socket contacts 63 inserted into said through hole 69, the through hole 69 of the socket-side connector has a diameter enough to allow a jig (not shown) which contracts the elastic protrusion 63*b* protruding in the radial direction at the front portion of the step portion 69*a* between the annular space 70 and the socket contacts 63.

A conventional connector 60 formed in this fashion possesses disadvantages described below.

Firstly, as shown in FIG. 12, there is the possibility of the plug contacts 61 being inserted into the socket contacts at an angle. That is to say, as shown in FIG. 13, because the engaging protrusions 68 provided near the center of both side surfaces of the socket-side casing respectively engage the engaging grooves 67 of the operation lever 65 attached to the plug-side casing, when the plug contacts 61 begin to contact the socket contacts 63, even though the engaging protrusions 68 have already engaged the engaging grooves 67 of the operation lever 65, the socket-side connector 64 is able to swing with respect to the plug-side connector 62 with said engaging protrusions 68 as the axis of rotation.

Additionally, when the proper positioning of the socket-side connector 64 is not performed with respect to the plug-side connector 62, the ends of the plug contacts 61 may miss the socket contacts 63 and become displaced in the annular space 70, as shown in FIG. 12.

Moreover, there is a possibility that the plug contacts 61 and the socket contacts 63 will become damaged when the plug contacts 61 are forcibly inserted into the socket contacts 63 while the plug contacts 61 are at an angle with respect to the socket contacts 63, because the insertion force is amplified by the operation lever 65.

Furthermore, when the plug contacts 61 are inserted into the socket contacts 63 at an angle, an enormous frictional force will be produced between the engaging grooves 67 of the operation lever 65 and the engaging protrusions 68 which engage the former, resulting in the wearing of the contact portions of the engaging grooves 67 and the engaging protrusions 68.

Also, since the plug-side casing is formed from a first and a second casing by splitting into two along the center in the latitudinal direction, the attaching and detaching of the operation lever 65 each time the assembling and disassembling of the casing is performed proves to be complex and time-consuming.

SUMMARY OF THE INVENTION

The object of the present invention is to offer a connector which overcomes the conventional problems described above, and which allows the stable insertion of multiple pairs of socket contacts and plug contacts that engage each other while being displaced in respective rows with the use of an operation lever.

In order to solve the problems described above, the present invention offers a connector which provides a plurality of plug contacts and socket contacts which respectively connects electrically within the inner portions of a pair of casings which engage respectively, and which are aligned therein, at least two engaging protrusions which are spaced apart in the direction orthogonal to the engaging direction of said casing on the opposing pair of side surfaces of first of said casings, a pair of engaging plates which can move in the direction orthogonal to the engaging direction on the opposing pair of side surfaces of the second of said casing; a pair of sliding grooves which can house and allow the sliding of said engaging plates in the direction orthogonal to the engaging direction on the side surfaces of the said second casing, at least two engaging grooves which are parallel to each other and where said engaging protrusions are inserted on the opposing pair of side surfaces of the said second casing, said engaging grooves having slanting portions which are slanted with respect to said engaging direction, an operation lever which can swing in order to move said engaging plates in a straight line simultaneously in the direction orthogonal to said engaging direction, and guiding grooves formed along said engaging direction which allow the insertion of said engaging protrusions.

The connector described above would be effective if a roller which rotates with respect to said engaging groove is provided on said engaging protrusion.

In addition, if said second casing is formed as a single body from said pair of sidewalls of said casing and a different sidewall, and is formed from a first casing portion which has a cross-sectional square C-shape and which has a opening portion in one direction and from a second casing portion which is attached onto to said first casing portion so as to close said opening portion, and wherein said operation lever is attached to said first casing portion, then the assembling and disassembling processes may be performed easily.

In such a case, said sliding groove may open at said opening portion.

Additionally, said second casing portion may be attached to said first casing portion by sliding said second casing portion along said groove formed in said engaging direction at the opening portion of said first casing portion, and a fixing means for stopping the relative movement of said first and second casing portions may be provided.

Furthermore, said fixing means may be formed in a slanting direction with respect to said sliding direction on both said first and second casing portions, and may comprise a through hole formed when both said first and second casing portions are attached, a bolt which is inserted into said through hole, and a nut which is screwed onto said bolt.

In the connector according to the present invention, the engaging protrusions provided on both side surfaces of a first casing are inserted into the guiding grooves provided on both side surfaces of a second casing and into the engaging grooves of the engaging plates. And by swinging the operation lever in this state, the engaging plates are moved in the direction orthogonal to the engaging direction. That is to say, the swinging motion of the operation lever is transformed into the linear motion of the engaging plates.

Since the engaging plate is inserted into the sliding grooves provided on said first casing, is stably moved in a straight line along said sliding grooves in the direction orthogonal to the engaging direction. Since the engaging protrusion is inserted into the guiding grooves and the engaging groove simultaneously and since the engaging groove has a slanting portion with respect to the engaging direction, when the engaging plate is moved linearly in the direction orthogonal to the engaging direction, the intersecting point of said engaging groove and said guiding groove moves in the engaging direction. Accordingly, the engaging protrusion inserted in both grooves is moved in the engaging direction along the guiding groove so that it is always positioned at the intersecting point of both of the grooves. That is to say, the linear motion of the engaging plate in the direction orthogonal to the engaging direction is transformed into a linear motion in the engaging direction.

In this case, at least two engaging protrusions spaced in the direction orthogonal to the engaging direction are formed on both side surfaces of said second casing, and the engaging grooves of the engaging plate are formed in parallel to each other, thereby allowing all engaging protrusions to simultaneously move a same amount in the engaging direction. Consequently, it is possible to have the casings not swing with respect to each other, and to have all of the plug contacts and the socket contacts engage each other while keeping them aligned.

In addition, if a roller which can rotate with respect to the engaging groove is provided on the engaging protrusion, it is possible to prevent the large amount frictional force produced between the engaging groove and the engaging protrusion by having the roller rotate with respect to the engaging groove when there is a large contact pressure produced between the engaging groove and the engaging protrusion by means of the operation lever.

Additionally, by having said second casing formed as a single body from said pair of sidewalls of said casing and a different sidewall, and formed from a first casing portion which has a cross-sectional square C-shape and which has a opening portion in one direction and from a second casing portion which is attached onto to said first casing portion so as to close said opening portion, and wherein said operation lever is attached to said first casing portion, it is possible to assemble or disassemble said casing merely by attaching or detaching the second casing portion with respect to the first casing portion and it is possible to eliminate the troublesome process of removing the operation lever each time assembly or disassembly is required.

Moreover, if the sliding groove is open at said opening portion, it is possible to slide the engaging plate in the casing by attaching the second casing portion to the opening portion after inserting the engaging plate into the sliding groove from said opening portion. Thus, by obviating long holes and metal fittings used for sliding mechanisms, it is possible to reduce costs and reduce the dimensions of the connector.

Furthermore, by having the second casing portion attached to the first casing portion by sliding the second casing portion along the groove formed in the engaging direction at the opening portion of the first casing portion, and by having a fixing means for stopping the relative movement of the first and second casing portions, it is possible to keep the number of parts of the above casing to a minimum.

In this case, by having the fixing means formed in a slanting direction with respect to the sliding direction on both the first and second casing portions, and by having the fixing means comprise a through hole formed when both the first and second casing portions are attached, a bolt which is inserted into that through hole, and a nut which is screwed onto that bolt, it is possible to prevent the second casing portion coming apart from the first casing portion by means of the friction generated between the bolt and the through hole slanting with respect to the sliding direction, as long as the bolt is inserted in the through hole, even when the nut becomes loose and falls off in the case where one carelessly forgets to tighten the nut.

DETAILED DESCRIPTION OF THE INVENTION

Herebelow, a preferred embodiment of the connector of the present invention shall be explained with reference to FIGS. 1–10.

Figure 1:
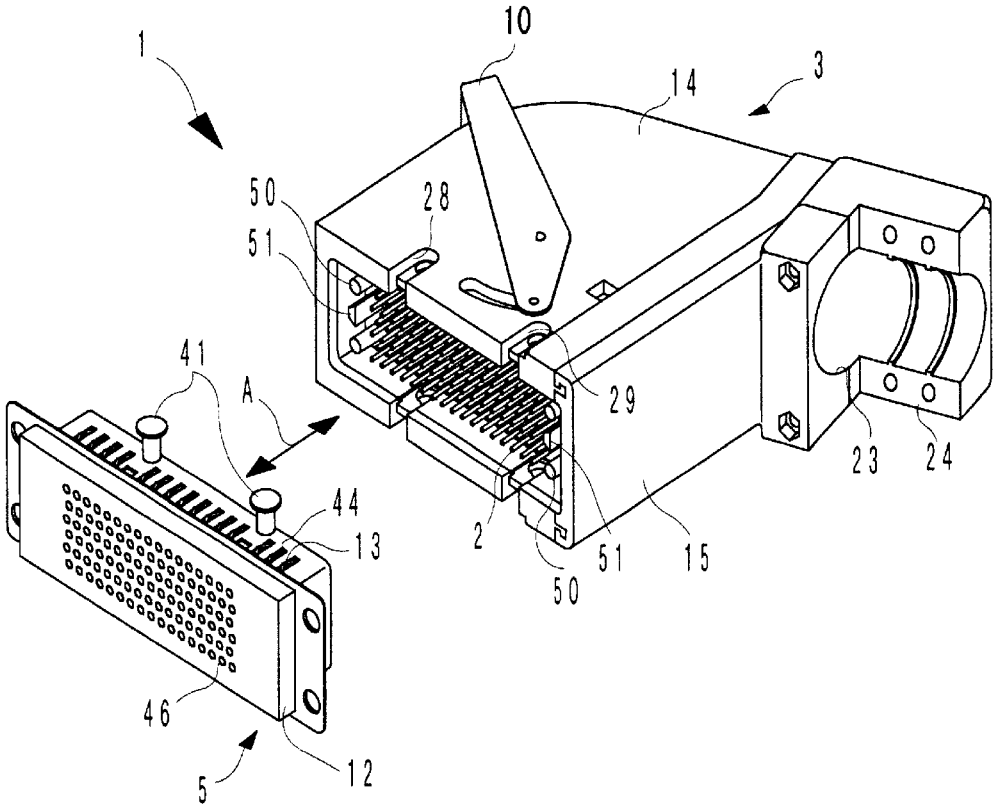
FIG. 1 is a perspective view showing a connector according to a preferred embodiment of the present invention.

As shown in FIG. 1, the connector according to the present preferred embodiment is formed of a plug-side connector 3 which houses a plurality of plug contacts 2 and a socket-side connector 5 which houses a plurality of socket contacts 4 (see FIG. 9) which engage with said plug contacts 2.

Hereinafter, the relative moving direction of connectors 3, 5 (the direction indicated by the arrow A in FIG. 1) for the engagement of the contacts 2, 5 will be referred to as the "engaging direction."

Figure 2:
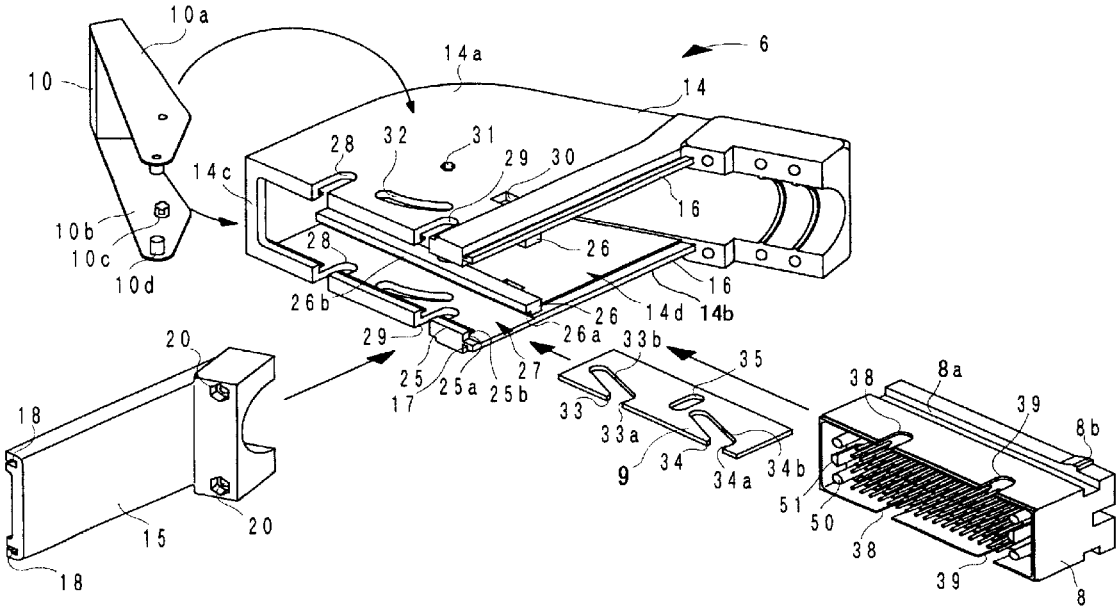
FIG. 2 is a disassembled perspective view showing the plug-side connector of the connector of FIG. 1.

Said plug-side connector 3, as shown in FIG. 2, provides a plug-side casing 6, a plug body 8 to maintain a plurality of plug contacts 2 in an array which is housed in said plug-side casing 6, two linearly movable engaging plates 9 (only one plate shown in drawing for simplicity) attached to said plug-side casing 6, and a swingable operation lever 10 attached to said plug-side casing 6.

Figure 3:
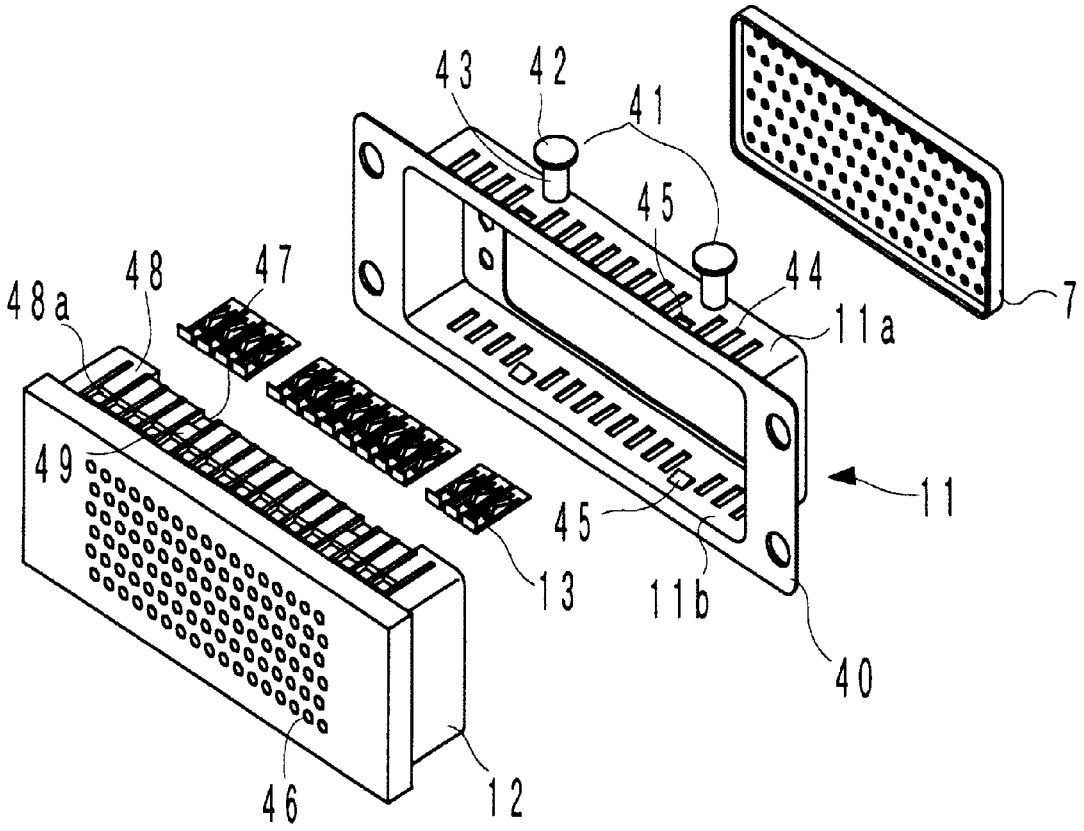
FIG. 3 is disassembled perspective view showing the socket-side connector of the connector of FIG. 1.

The socket-side connector 5, as shown in FIG. 3, provides a socket-side casing 11 and a socket body 12 to maintain a plurality of socket contacts 4 in an array which is housed in said socket-side casing 11. In FIG. 3, reference numeral 13 refers to a ground contact for shield contact described later, and for simplicity, and said ground contact is shown only on one side of said socket body 12. Reference numeral 7 within FIG. 3 is a guide plate.

Said plug-side casing 6 has a rectangular cross-sectional shape, and is formed of a first casing portion 14 having a cross-sectional square C-shape formed as a single body from a pair of long sidewalls 14*a*, 14*b* facing each other in the latitudinal direction and a different single short sidewall 14*c* and a second casing portion 15 having a flat plate shape attached to said first casing portion 14 so as to close an opening portion 14*d* forming a box-shaped plug-side casing 6. Said first and second casing portions 14, 15 may be made by, for example, injection molding with electrically insulating materials. Also, the inner surface of said casing portions 14, 15 is plated with a conductive material, for example, having nickel plating, in order to produce a shielding effect by allowing electrical conduction with said socket-side connector 5 described later.

On said opening portion 14*d* of said first casing portion 14, two rails 16 disposed in the engaging direction are provided, and on the outer side of said first casing portion 14 in the latitudinal direction, two straight grooves 17 along said rails 16 are provided. On said second casing portion 15, grooves 18 are provided which cross-sectionally perfectly fit said rails 16 and grooves 17. Accordingly, said second casing portion 15 is attached to said first casing portion 14 so as to fit said rails 16 into said grooves 18 in the engaging direction of said connector 1.

Figure 4:
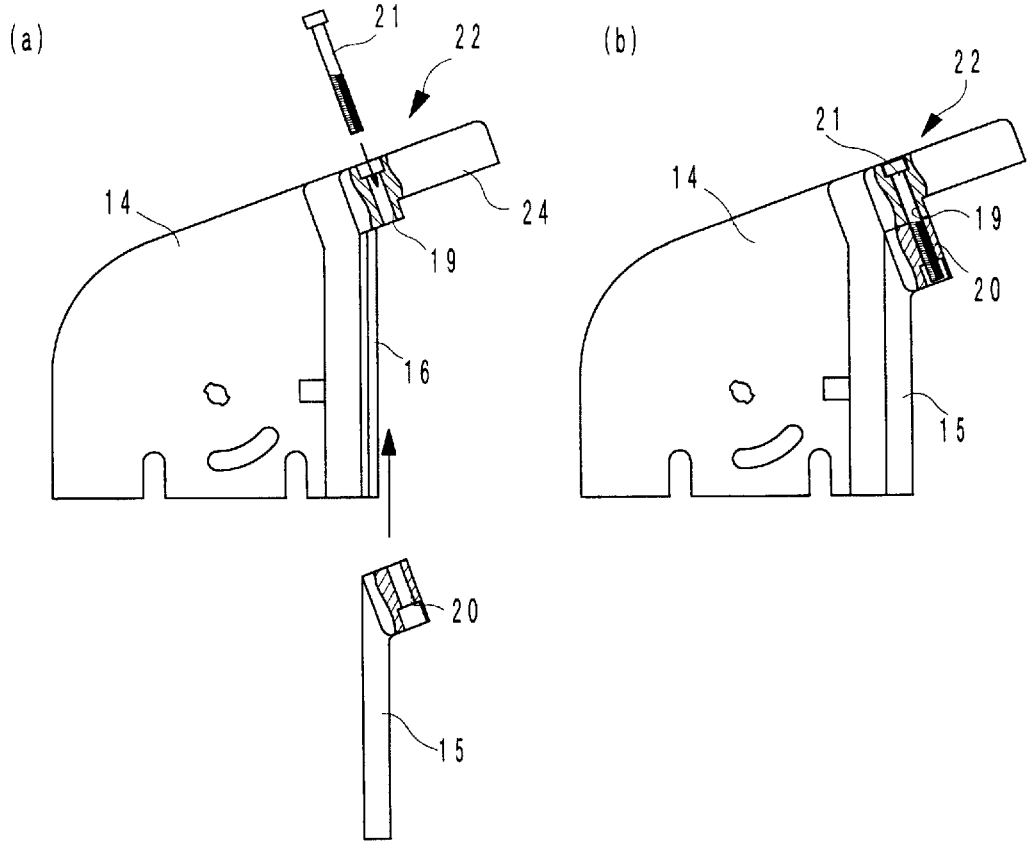
FIG. 4 is a partial cross-sectional frontal view describing the operation of the fixing means of the plug-side connector of FIG. 2, where (a) is a disassembled view, and (b) is an assembled view.
Figure 5:
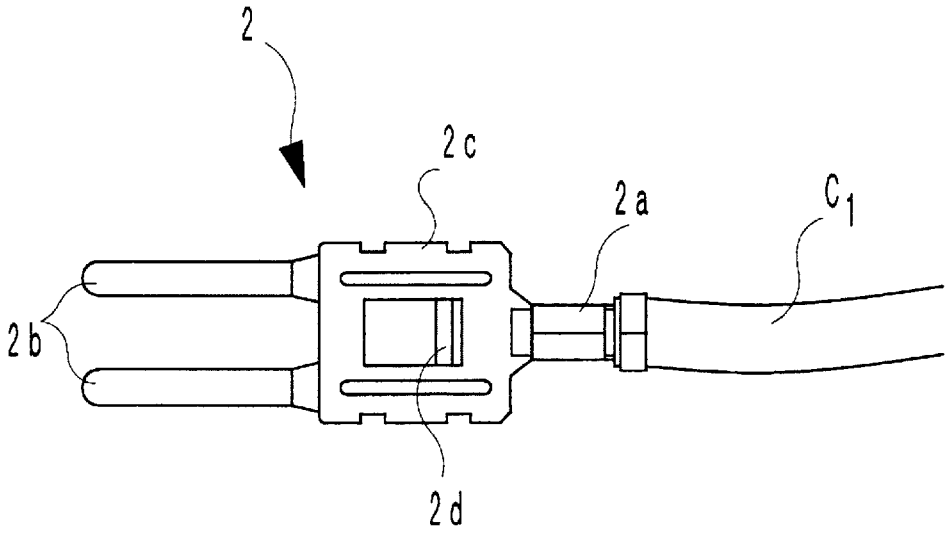
FIG. 5 is a frontal view showing the plug contacts of FIG. 1.

Additionally, through holes 19, 20 are formed respectively on said casing portion 14 and said casing portion 15 and achieve its intended final form when said casing portions 14, 15 are fitted together. As shown in FIGS. 4 and 5, said through holes 19, 20 are formed at an angle with respect to said engaging direction, that is, the sliding direction of said second casing portion 15 with respect to said first casing portion 14. Also, a fixing means 22 is formed by a bolt 21 which is inserted into said through holes 19, 20 and a nut (not shown) screwed onto said bolt when said through holes 19, 20 are in its intended final form.

As shown in FIG. 1, when said second casing portion 14 is attached to said first casing portion 15 and when said casing portions 14, 15 are fixed by said fixing means 22, a insertion hole 23 for a cable (not shown) is demarcated by said first and second casing portions 14, 15. Within the drawing, reference numeral 24 is a cable fixing portion for fixing said cable which is passed into said plug-side casing through said insertion hole 23 to said plug-side casing.

As shown in FIG. 2, a pair of protrusions 25, 26 which are separated by a fixed amount in said engaging direction are formed in the direction orthogonal to said engaging direction on the inner surfaces of said long sidewalls 14*a*, 14*b* of said first casing portion 14. Linear grooves 25*a*, 26*a* are formed on the side surfaces between said two protrusions 25, 26 formed on the inner surface of each sidewall 14*a*, 14*b*, along said two protrusions 25, 26, and sliding grooves 27 which possess a fixed width and where engaging plates 9 described later are inserted are formed by said linear grooves 25*a*, 26*a*. Said sliding grooves 27 are formed so as to support said engaging plates 9 within said sliding grooves 27 by means of brim portions 25*b*, 26*b* which makes the groove width narrower at the opening of the inner side of said casing portion 14. Also, one end of said sliding groove 27 is open at the opening portion 14*d* of said first casing portion 14 and the insertion of said engaging plate 9 is made possible through there.

Among said pair of protrusions 25, 26 on the inner surface of each of said long sidewall 14*a*, said protrusion 26, in conjunction with said protrusion 26 on the opposing inner surface of said long sidewall 14*b*, guides the insertion of said plug body 8 described later into said first casing portion 14, and forms the guide rails which keeps said plug body 8 in a fixed state within said first casing portion 14.

Linear guide grooves 28, 29 which are disposed in the longitudinal direction from the engaging end are provided on said long sidewalls 14*a*, 14*b* of said first casing portion 14. Said guide grooves 28, 29 are formed partway into said sliding groove in the groove width direction of said sliding groove 27 so as to cut across said protrusion 25 and said sliding groove 27. Reference numeral 30 indicates a stopping hole for holding said plug body 8 described later in a stored state.

Next, attachment holes 31 for attaching an operation lever 10 described later is disposed roughly in the center of said long sidewalls 14*a*, 14*b* of said first casing portion 14, and arc-shaped holes 32 whose arc has an axis of rotation at said attachment holes 31 are formed within said sliding grooves 27 between said guiding grooves 28, 29.

Said operation lever 10 is a square C-shaped member which connects the ends of two plate-shaped arms 10*a*, 10*b*, and provides on the opposing inner surfaces of said arms 10*a*, 10*b*, hub-shaped swinging axes 10*c* which engage said attachment holes 31 provided on said first casing portion 14, and hub-shaped drive protrusions 10*d* which are inserted into said arc-shaped holes 32.

As shown in FIG. 2, said engaging plate 9 is a rectangular, flat plate having two engaging grooves 33, 34 and one oblong hole 35. Said engaging grooves 33, 34 provides linear insertion portions 33*a*, 34*a* which extend in the width direction from one side of said engaging plate 9, and slanting portions 33*b*, 34*b* which extend at a slanting angle with respect to said insertion portions 33*a*, 34*a* from front ends of said insertion portions 33*a*, 34*a*. Both said insertion portions 33*a*, 34*a* and said slanting portions 33*b*, 34*b* of said engaging grooves 33, 34 are formed so as to be respectively parallel. Said oblong hole 35 is formed roughly at midpoint between said insertion portions 33*a*, 34*a* of said two engaging grooves 33, 34, and is formed linearly parallel to said insertion portions 33*a*, 34*a* in said engaging direction.

Said plug contacts 2 may be a two-pronged contact, as shown in FIG. 5, and provide a crimp portion 2*a* which crimps to a cable $C_1$, two plug portions 2*b*, and a stopping portion 2*c* disposed between said crimp portions 2*a* and said plug portions 2*b*. Further, said plug portions 2*b* are rod-shaped. Said stopping portion 2*c* has a flat plate shape and connects said crimp portion 2*a* and said plug portions 2*b*. An elastic plate 2*d* which elastically sticks out of the flat surface of said stopping portion 2*c* is formed in the center of said stopping portion 2*c*.

Figure 6:
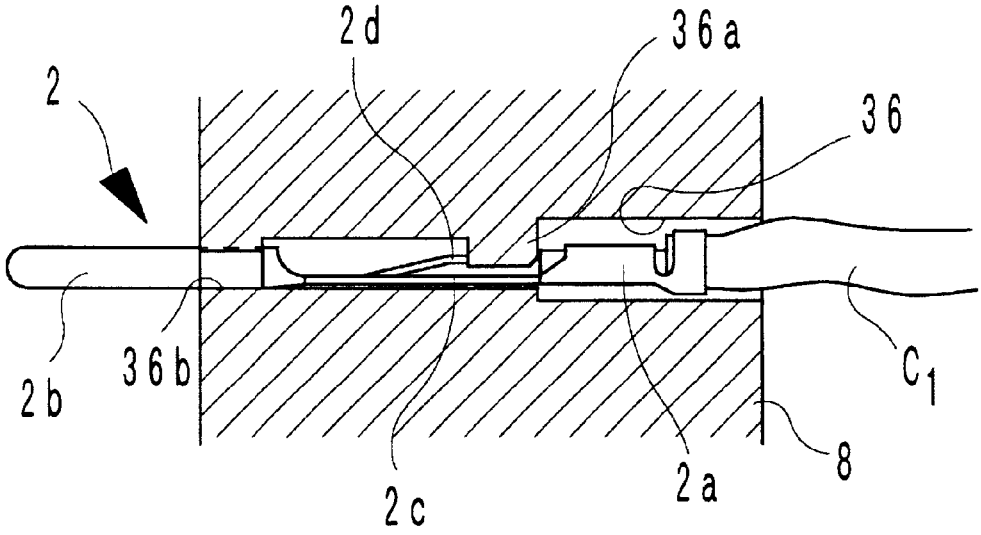
FIG. 6 is a side view showing the state in which the plug contact of FIG. 5 is inserted into the plug body.

Said plug body 8 is a block made of electrically insulating material and provides a plurality of through holes 36 wherein said plug contacts 2 are inserted. As shown in FIG. 6, a protrusion 36*a* is formed partway inside said through hole 36, and is designed to be sandwiched between said crimp portion 2*a* and said elastic plate 2*d* of said plug contact 2, thereby allowing the fixing of said plug contact 2 in the axial direction.

That is to say, when said plug contact 2 is inserted into said through hole 36 of said plug body 8 from said plug portion 2*b* side, it passes through said protrusion 36*a* inside said through hole 36 with said elastic plate 2*d* in an elastically deformed state. Said elastic plate 2*d* returns to its original shape after completely passing said protrusion 36*a*, thereby having said protrusion 36*a* sandwiched between said elastic plate 2*d* and said crimp portion 2*a* and ultimately having said plug contact 2 fixed so that it cannot move in the axial direction.

Figure 7:
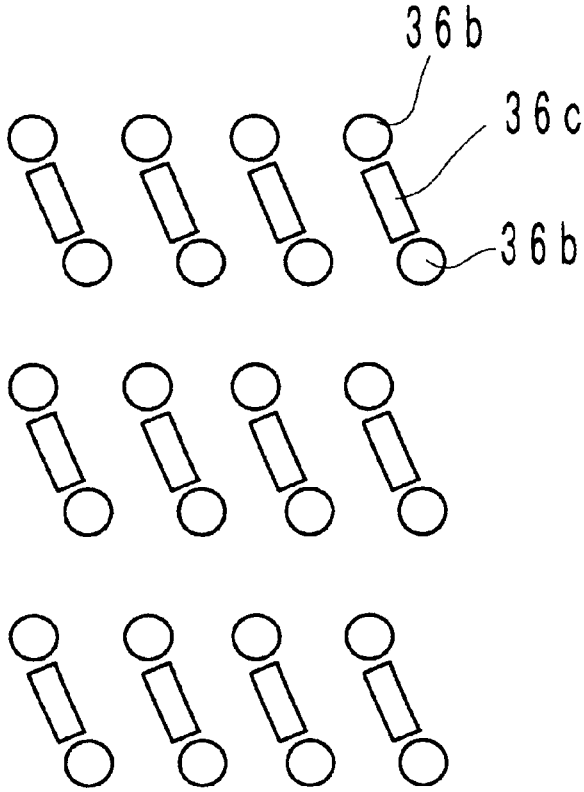
FIG. 7 is a plan view showing the jig insertion hole and the plug hole of the plug body onto which the plug contact of FIG. 5 is attached.

Additionally, said plug body 8, as shown in FIG. 7, provides plug holes 36*b* which support said plug portions 2*b* for each of said plug contacts 2, and a jig insertion hole 36*c* between each pair of said plug hole 36*b* in order to release the engagement of said elastic plate 2*d* with said protrusion 36*a* by elastic deformation by means of inserting a jig (not shown).

Furthermore, as shown in FIG. 2, engaging grooves 8*a* which engage said guide rails 26 provided on said first casing portion 14 are provided on both side surfaces of the long sides of said plug body 8 in the longitudinal direction. Reference numeral 8*b* indicates the stopping protrusion which holds said plug body 8 housed within said first casing portion 14 by means of having said stopping protrusion catch said stopping hole 30 provided on said first casing portion 14 when said plug body 8 is inserted into said first casing portion 15 along said guide rails 26, and said stopping protrusion is provided near the rear of said plug body 8 with respect to the insertion direction.

Also, grooves 38, 39 are formed on both side surfaces of said plug body 8 so as to match up with said guiding grooves 28, 29 of said first casing portion 14 in the state where said plug body 8 is housed within said first casing portion 14.

Said socket-side casing 11 is a box-shaped member and provides a flange 40 for attaching to an external structure, in addition to engaging protrusions 41 on both side surfaces of said socket-side casing 11 which is inserted into said guiding grooves 28, 29 of said plug-side casing 6. Two of said engaging protrusions 41 are formed spaced apart by an amount equal to the distance separating said guiding grooves 28, 29 of said plug-side casing 6, and are formed in the direction orthogonal to said engaging direction. Also, said engaging protrusions 41 are disposed slightly away from the center line of said socket-side casing 11.

Figure 8:
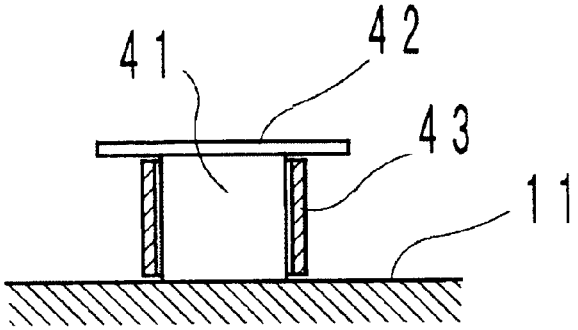
FIG. 8 is a cross-sectional view showing the engaging protrusion provided on the socket-side connector of FIG. 3.

Said engaging protrusions 41 have height sufficiently greater than said sidewalls 14*a*, 14*b* of said plug-side casing 6 and said engaging plate 9 combined, and provides a brim portion 42 at the ends thereof having a diameter larger than the width of said guiding grooves 28, 29. Formed with a cylindrical shape, said engaging protrusions 41 is fitted with rotatable tube-shaped roller 43 around the perimeter thereof as shown in FIG. 8.

A plurality of rectangular holes 44 are provided on the long sidewalls 11*a*, 11*b* of said socket-side casing 11 aligned in said engaging direction. Ground contacts 13 are inserted and disposed in each of said rectangular holes 44. Reference numeral 45 is a stopping plate for holding said socket body 12 in a housed state, which protrudes inward and engages said socket body 12.

Figure 9:
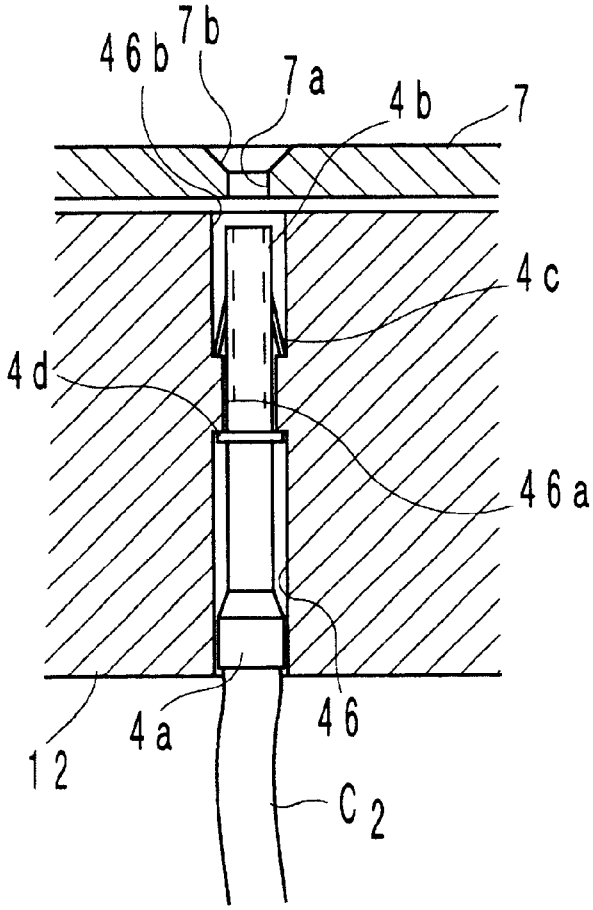
FIG. 9 is a frontal view showing the state where the socket contact of FIG. 1 is inserted into socket body.

Said socket body 12 is a rectangular block member formed of electrically insulating material, and provides a plurality of through holes 46 which each respectively engage with said socket contacts 54. Said through hole 46, as shown in FIG. 9, forms partway therein, a small diameter portion 46*a* with a certain length which has diameter smaller than said through hole 46.

A plurality of housing grooves 48 for housing said ground contacts 13 and guiding grooves 47 for guiding said stopping plate 45 of said socket-side casing 11 are provided in said engaging direction on both side surfaces of said socket body 12. Stopping protrusions 49 for keeping said socket body 12 housed within said socket-side casing 11 by engaging with said stopping plate 45 when said socket body 11 is completely housed within said socket body 12, are disposed in a protruding state partway in said engaging direction. Also, indented portions 48*a* which allow the elastic deformation of said ground contacts 13 are provided partway in said housing grooves 48 in said engaging direction.

Said socket contact 4 provides crimp portion 4*a* for crimping cable $C_2$, a socket portion 4*b* allowing insertion of said plug portion 2*b* of said plug contact 2, an elastic protrusion 4*c* which elastically protrudes in a radial fashion disposed between said socket portion 4*b* and said crimp portion 4*a*, and a brim-shaped flange portion 4*d* disposed so as to have a certain amount of space separating it from said elastic protrusion 4*c* in the longitudinal direction. Said elastic protrusion 4*c* has a dimension allowing it to pass through said small diameter portion 46*a* of said through hole 46 when in a radially contracted state, and sandwiches said small diameter portion 46*a* with said flange portion 4*d* when in a radially protruding state, in which case said socket contact 4 becomes fixed within said through hole 46.

As shown in FIG. 3, said removable guide plate 7 is attached to the front surface of said socket body 12 housed within said socket-side casing 11. Said guide plate 7, as shown in FIG. 9, possesses an insertion hole 7*a* having a diameter slightly smaller than the outer diameter of said socket portion 4*b* and slightly larger than inner diameter of said socket portion 4*b* of said socket contact 4, and a tapering portion 7*b* whose diameter gradually decreases toward said insertion hole 7*a*.

When said guide plate 7 is attached to the front surface of said socket body 12, the annular space 46*b* formed between said through hole 46 of said socket body 12 and said socket portion 4*b* as well as the front end surface of said socket portion 4*b* are covered by said guide plate 7. Accordingly, when said plug portion 2*b* is being inserted, said plug portion 2*b* is guided into said insertion hole 7*a* by said tapering portion 7*b*, and the front end of said plug portion 2*b* is guided into said socket portion 4*b* without getting caught on the front end surface of said socket portion 4*b*.

When detaching said socket contact 4 from said socket body 12, it is possible to insert a jig (not shown) into said annular space 46*b* after exposing said annular space 46*b* around said socket contact 4 by means of removing said guide plate 7 from said socket-side casing 11.

Herebelow, the method of assembling above-described said connector 1 will be explained.

Firstly, insert said plurality of plug contacts 2 crimping the front ends of said cable $C_1$ into each of said through holes 36 of said plug body 8, as shown is FIG. 6. Have said elastic plate 2*d* of said plug contact 2 pass through said protrusion 36*a* within said through hole 36 by elastic deformation and have it return to its original shape, and fix said plug contact 2 in said plug body 8 by sandwiching said protrusion 36*a* between said elastic plate 2*d* and said crimp portion 2*a*. Next, attach guiding pins 50 and polarized keys 51 onto said plug body 8.

Next, insert said plurality of socket contacts 4 crimping the front ends of said cable $C_2$ into each of said through holes 46 of said socket body 12, as shown is FIG. 9. Have said elastic protrusion 4*c* of said socket contact 4 pass through said small diameter portion 46*a* within said through hole 46 by elastic deformation and have it return to its original shape, and fix said socket contact 5 in said socket body 12 by sandwiching said small diameter portion 46*a* between said elastic protrusion 4*c* and said flange portion 4*d*.

Next, dispose each of said ground contacts 13 inside said housing grooves 48 of the side surfaces of said socket body 12, and in that state, insert said socket body 12 into said socket-side casing 11. Said socket body 12 is then maintained in a housed state within said socket-side casing 11 by means of having said stopping plates 45 of said socket-side casing 11 engage with said stopping protrusions 49 of said socket body 12. Next, said ground contacts 13 which are disposed within said housing grooves 48 are sandwiched between said socket-side casing 11 and said socket body 12, and is disposed in an electrically conductive state with respect to said socket-side casing 11, and is disposed so as to stick out through said rectangular holes 44, as shown in FIG. 1. This concludes the assembly of said socket-side connector 5.

Next, two engaging plates 9 are inserted into said sliding grooves 27 provided on the inner surfaces of said first casing portion 14 of said plug-side connector 3 through said opening portion 14*d* of said casing portion 14. Then, insert said swinging axes 10*c* and said drive protrusions 10*d* into said attachment holes 31 and said arc-shaped holes 32 of said first casing portion 14, respectively, and attach said operation lever 10. Said drive protrusions 10*d* are inserted into said oblong holes 35 provided on said engaging plates 9.

Figure 10:
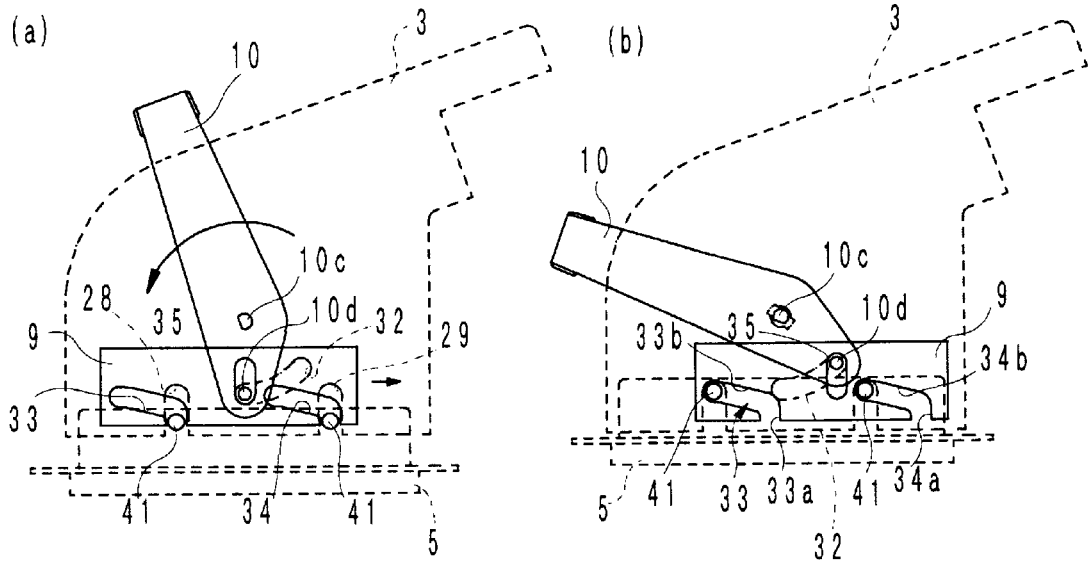
FIG. 10 is a conceptual view describing the operation of the engaging plate of the connector of FIG. 1.
Figure 11:
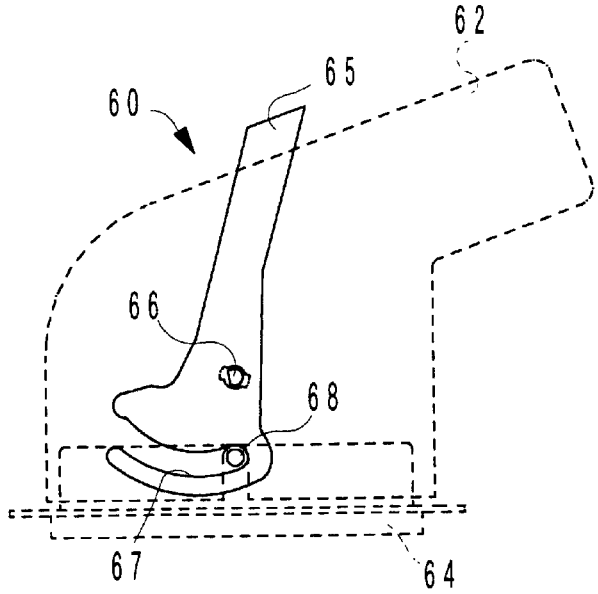
FIG. 11 is a conceptual view showing a conventional connector.
Figure 12:
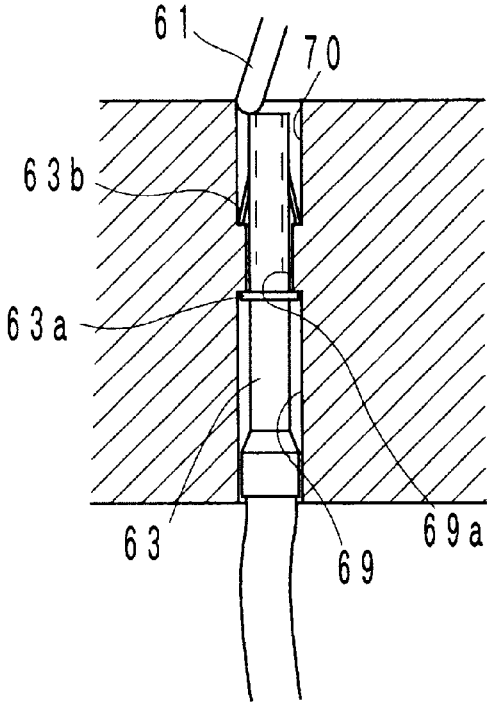
FIG. 12 is a frontal view showing the state where the socket contact of the connector of FIG. 11 is inserted into the socket body.
Figure 13:
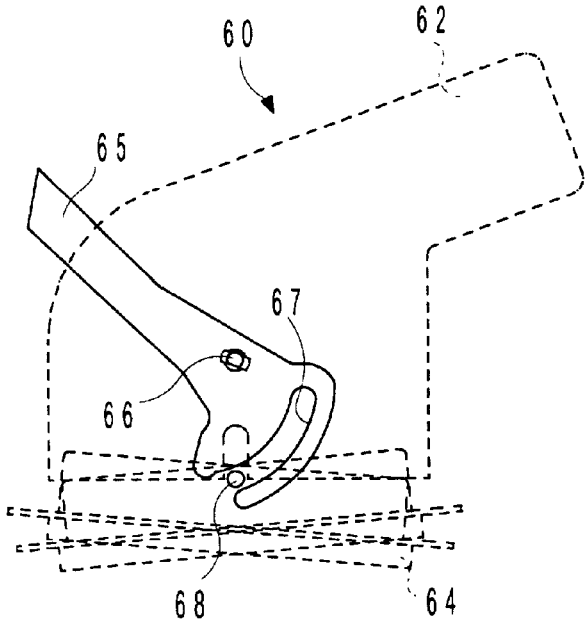
FIG. 13 is a conceptual view describing the operation during the engagement of the connector of FIG. 11.

Accordingly, as shown in FIGS. 10(*a*), 10(*b*), when said operation lever 10 is swung with respect to said first casing portion 14 having said swinging axes 10*c* as the axis of rotation, said drive protrusions 10*d* move along said arc-shaped holes 32, and said drive protrusions 10*d* push the side surfaces of said oblong holes 35 and make said engaging plates 9 slide along said sliding grooves 27. In other words, the rotational motion of said operation lever 10 is transformed into the linear motion of said engaging plates 9 by means of said drive protrusions 10*d* and said oblong holes 35 working together.

As shown in FIG. 2, insert said plug body 8, onto which the above-described plug contacts 2 are attached, into said first casing portion 14 formed as described above. At this point, it is possible to insert said plug body 8 which is electrically wired, since said first casing portion 14 according to the preferred embodiment is formed as a single body from said pair of sidewalls of said casing and a different sidewall, and is formed from a first casing portion which has a cross-sectional square C-shape.

During the above insertion, insert said plug body 8 along said guide rail 26 until said stopping protrusions 8*b* is stopped by said stopping holes 30 provided on said sidewalls 14*a*, 14*b* of said first casing portion 14, by having said engaging grooves 8*a* provided on said plug body 8 engage said guide rails 26 of said first casing portions 14. In this state, said grooves 38, 39 of said plug body 8 should match up with said guiding grooves 28, 29 of said first casing portions 14, and said plug body 8 will be fixed in a housed state within said first casing portion 14.

Next, said opening portion 14*d* of said first casing portion 14 is closed by means of said second casing portion 15. That is, said opening portion 14*d* is closed by first having said grooves 18 of said second casing portion 15 engage with said rails 16 disposed at said opening portion 14*d*, and then moving said second casing portion 15 move along said rails 16 in said engaging direction. Said cable C1 crimped to said plug contact 2 is passed through said insertion hole 23 demarcated by said first and second casing portions 14, 15, and is held fixed in place by said cable fixing portion 24.

Then, by moving said second casing portion 15 in said engaging direction onto said first casing portion 14 until said second casing portion 15 reaches the far end, said through holes 19, 20 provided on said first and second casing portions 14, 15, respectively, achieve its final intended form. Then, by inserting said bolt 21 into this through hole and by screwing on a nut, the assembly of said plug-side connector 3 is complete.

With said connector 1 of the preferred embodiment, since said first casing portion 14 is formed in a square C-shape, it is possible to attach and detach said plug body 8 wired with cable C1 through said opening portion 14*d*. Specifically, there is an advantage of simplified operation when detaching said plug body 8, because the removal of an operation lever from the plug-side casing is obviated unlike in the conventional case where the plug-side casing and the operation lever required to be separated at center of the plug-side casing in width direction.

Also, said connector 1 according to the preferred embodiment has the advantage of simplifying the assembling and disassembling operations of said first casing portion 14, said engaging plates 9, and said plug body 8 by requiring only the insertion of said engaging plates 9 and said plug body 8 along said sliding grooves 27 and said guide rails 26, because the front ends of said sliding grooves 27 and said guide rails 26 where said engaging plates 9 and said plug body 8 are inserted, respectively, are disposed at said opening portion 14*d* of said first casing portion 14.

In said connector 1 of the preferred embodiment, both of said casing portions 14, 15 are fixed together by means of screwing a nut onto said bolt 21 after having said second casing portion 15 slide in said engaging direction and attach to said first casing portion 14, and further provides said through holes 19, 20 into which said bolt 21 is inserted, at a slanting angle with respect to said sliding direction, thus even in the case where the nut screwed onto said bolt 21 becomes lost, there is an advantage of not having both of said casing portions 14, 15 come apart because the movement of said second casing portion 15 in said sliding direction is not allowed due to the friction generated between said bolt 21 and said through holes 19, 20.

Next, the process of connecting said plug-side connector 3 assembled as described above and said socket-side connector 5 will be explained below.

Firstly, dispose said operation lever attached to said plug-side connector 3 at the position shown in FIG. 10(*a*). In this state, said engaging plates 9 within said plug-side connector 3 is disposed so that said insertion portions 33*a*, 34*a* of said engaging grooves 33, 34 of said engaging plates 9 within said plug-side connector 3 is matched up with said guiding grooves 28, 29 formed on said plug-side casing 6.

Then in this state, dispose both of said connectors 3, 5 so as to have all four of said engaging protrusions 41, two provided on each of the two opposing walls of said socket-side connector 5, move into said guiding grooves 28, 29 of said plug-side connector 3.

In said connector 1 of the preferred embodiment, since said guide plates 7 are disposed on the front surface of said socket-side connector 5, the front ends of said plug portions 2*b* of each of said plug contacts of said plug-side connector 3 enter said insertion holes 7*a* being guided by said tapering portion 7*b* of said guide plates 7. Since the bore diameter of said insertion hole 7*a* is formed so as to be smaller than the outer diameter of said socket connector 4, said plug portion 2*b* inserted into said insertion hole 7*a* is guided into said socket portion 4*b* without getting caught on the front end of said socket portion 4*b* or in said annular space 46*b* formed around said socket contact 4.

When said both of said connectors 3, 5 fit together, said engaging protrusions 41 is disposed in said insertion portion 33*a*, 34*a* of said engaging grooves 33, 34 which are aligned with said guiding grooves 28, 29. Since each of said engaging protrusions 41 are disposed at a differing distance from the center of said socket-side connector 5 in said connector 1 of the preferred embodiment, it is possible to definitely prevent the insertion of said socket-side connector 5 in the wrong direction with respect to said plug-side connector 3.

Next, swing said operation lever 10 until reaching the position shown in FIG. 10(*b*) having said swinging axes 10*c* as the axis of rotation. Consequently, said drive protrusions 10*d* provided at the ends of said operation lever 10 move said engaging plates 9 in the direction orthogonal to said engaging direction by moving along said arc-shaped holes 32 of said plug-side casing 6. Then, said engaging protrusions 41 disposed in said insertion portions 33*a*, 34*a* of said engaging grooves 33, 34 of said engaging plates 9 is moved in said engaging direction along said guiding grooves 28, 29 formed on said plug-side casing 6 by being moved along said slanting portion 33*b*, 34*b* of said engaging grooves 33, 34.

In other words, according to said connector 1 of the preferred embodiment, because two of said engaging protrusions 41 on one of the sides are moved simultaneously in said engaging direction due to said parallel engaging grooves 33, 34 provided said engaging plate 9, said socket-side connector 5 performs the engaging operation while maintaining its orientation perpendicular to said engaging direction. Consequently, having the engaging operation proceed while having said plug contacts 2 disposed at an angle with respect to said socket contacts 4 as with conventional connectors can be definitely prevented, thus preserving the structural integrity of the contacts.

Also, since said roller 43 is provided on said engaging protrusion 41, the rotation of said rollers 43 within said engaging grooves 33, 34 allows said engaging protrusions 41 to move smoothly, as well as, preventing said engaging grooves 33, 34 of said engaging plates 9 and said engaging protrusions 41 from wear when there is a large insertion force applied by said operation lever 10.

Since said connector 1 of the preferred embodiment employs a two-pronged contact for said plug contact 2, said socket-side connector 5 may utilize dual lines. That is to say, it is possible to connect to equipment which utilizes dual line for safety reasons or for migrating from old systems to new systems solely with said connector 1 of the preferred embodiment, and because other equipment for creating dual channels is unnecessary, reduction in the number of parts, assembling processes, and in size can be achieved.

Also, by employing this two-pronged contact, it is possible to provide said stopping portion 2*c* for fixing said plug contact 2 to said plug body 8 in between said two plug portions 2*b*, and the removal of said plug contact 2 is simplified by employing said jig insertion hole 36*c* disposed between said plug portions 2*b*.

When said socket-side connector 5 fully engages said plug-side connector 3 in this manner, said ground contacts 13 disposed on the side surface of said socket-side connector 5 so as to elastically protrude, become elastically deformed, and provide a repulsive force for maintaining pressure contact against the inner surfaces of said plug-side casing 14. Since the inner surface of said plug-side casing 14 is plated with an electrically conductive material, said ground contacts 13 may conduct electricity to said plug-side casing 14. Accordingly, it is possible to connect said plug-side connector 3 and said socket-side connector 5 to the same ground wire, resulting in increased shielding effect.

Although two of said engaging protrusions are provided on each of the two side surfaces of said socket-side connector 5 in the connector according to the preferred embodiment, it is in no way restricted to such and may well provide 3 or more. Also, although said plug-side casing was described as being formed by injection molding, any arbitrary method such as casting may be used for its manufacture.

Furthermore, the plugs and sockets of said plug-side connector 3 and said socket-side connector 5 may be freely interchanged.

As described above, the connector according to the present invention can very well prevent the engaging operation of the socket contacts and the plug contacts from proceeding when misaligned, because at least two of said engaging protrusions provided so as to be spaced apart in the direction orthogonal to the engaging direction on both of the side surfaces of one of said casings, move simultaneously in said engaging direction by means of said slanting portion of said engaging groove. As a result, it is possible to prevent the disadvantage of the damage incurred on said socket contacts or plug contacts due to the insertion force when a large insertion force is applied via said operation lever.

With the presence of said roller on said engaging protrusion, the friction generated between said engaging protrusion and said engaging groove may be alleviated and may prevent the wearing of said engaging protrusion as well as said engaging groove when a large insertion force is applied via said operation lever.

Also, by having one of said casing is formed from a first casing portion which has a cross-sectional square C-shape and which has a opening portion in one direction and from a second casing portion which is attached onto to said first casing portion so as to close said opening portion, said operation lever need not be removed from said first casing portion, and only said second casing portion need be detached, when attaching or detaching said cable, thereby simplifying the assembling and disassembling processes.

Additionally, there is an advantage of simplifying the assembling operation because said engaging plate may be inserted into said sliding grooves from said opening portions which is due to said sliding grooves providing openings at said opening portions.

Further, by having the second casing portion attached to the first casing portion by sliding the second casing portion along the groove formed in the engaging direction at the opening portion of the first casing portion, and by having a fixing means for stopping the relative movement of the first and second casing portions, it is possible to keep the number of parts of the above casing to a minimum.

Finally, by having said fixing means formed in a slanting direction with respect to said sliding direction on both said first and second casing portions, and by having said fixing means comprise a through hole formed when both said first and second casing portions are attached, a bolt which is inserted into that through hole, and a nut which is screwed onto that bolt, it is possible to prevent said second casing portion coming apart from said first casing portion by means of the friction generated between said bolt and said through hole slanting with respect to said sliding direction, as long as said bolt is inserted in said through hole, even when the nut becomes loose and falls off in the case where one carelessly forgets to tighten the nut.

What is claimed is:

1. A connector comprising:

a plurality of plug contacts and socket contacts which respectively connects electrically within the inner portions of a pair of casings which engage respectively, and which are aligned therein;

at least two engaging protrusions which are spaced apart in the direction orthogonal to the engaging direction of said casing on the opposing pair of side surfaces of first of said casings;

a pair of engaging plates which can move in the direction orthogonal to the engaging direction on the opposing pair of side surfaces of the second of said casings;

a pair of sliding grooves which can house and allow the sliding of said engaging plates in the direction orthogonal to the engaging direction on the side surfaces of the said second casing;

at least two engaging grooves which are parallel to each other and where said engaging protrusions are inserted on the opposing pair of side surfaces of the said second casing;

said engaging grooves having slanting portions which are slanted with respect to said engaging direction;

an operation lever which can swing in order to move said engaging plates in a straight line simultaneously in the direction orthogonal to said engaging direction; and guiding grooves formed along said engaging direction which allow the insertion of said engaging protrusions;

wherein the second casing has an opening in one side, and wherein the pair of engaging plates and a body, holding at least one of the plurality of plug contacts or socket contacts in the second casing, are inserted into the second casing through the opening.

2. A connector in accordance with claim 1, further comprising a roller which rotates with respect to said engaging groove on said engaging protusion.

3. A connector according to claim 1, wherein the said second casing is formed as a single body from said pair of sidewalls of said casing and a different sidewall, and is formed from a first casing portion which has a cross-sectional square C-shaped and which has a opening portion in one direction and form a second casing portion which is attached onto to said first casing portion so as to close said opening portion, and wherein said operation lever is attached to said first casing portion.

4. A connector in accordance with claim 3, wherein said sliding groove is open at said opening portion.

5. A connector in accordance with claim 3, wherein said second casing portion is attached to said first casing portion by sliding said second casing portion along said groove formed in said engaging direction at the opening portion of said first casing portion, further comprising a fixing means for stopping the relative movement of said first and second casing portions.

6. A connector comprising:

a plurality of plug contacts and socket contacts which respectively connects electrically within the inner portions of a pair of casings which engage respectively, and which are aligned therein;

at least two engaging protrusions which are spaced apart in the direction orthogonal to the engaging direction of said casing on the opposing pair of side surfaces of first of said casings;

a pair of engaging plates which can move in the direction orthogonal to the engaging direction on the opposing pair of side surfaces of the second of said casings;

a pair of sliding grooves which can house and allow the sliding of said engaging plates in the direction orthogonal to the engaging direction on the side surfaces of the said second casing;

at least two engaging grooves which are parallel to each other and where said engaging protrusions are inserted on the opposing pair of side surfaces of the said second casing;

said engaging grooves having slanting portions which are slanted with respect to said engaging direction;

an operation lever which can swing in order to move said engaging plates in a straight line simultaneously in the direction orthogonal to said engaging direction; and guiding grooves formed along said engaging direction which allow the insertion of said engaging protrusions;

wherein the second casing is formed from a first casing portion and a second casing portion attached onto the first casing portion by sliding said second casing portion along a sliding groove formed in said engaging direction on said first casing portion, the second casing further comprising fixing means for stopping the relative movement of said first and second casing portions, wherein said fixing means is formed in a slanting direction with respect to said sliding direction on both said first and second casing portions, and comprises a through hole formed when both said first and second casing portions are attached, a bolt which is inserted into said through hole, and a nut which is screwed onto said bolt.

* * * * *